United States Patent [19]

Lanfermann

[11] 4,184,715

[45] Jan. 22, 1980

[54] RACK DEVICE FOR A DRUM CUTTER MINING MACHINE

[75] Inventor: Willy Lanfermann, Bochum, Fed. Rep. of Germany

[73] Assignee: Gebr. Eickhoff, Maschinenfabrik und Eisengiesserei m.b.H., Bochum, Fed. Rep. of Germany

[21] Appl. No.: 882,304

[22] Filed: Feb. 27, 1978

[30] Foreign Application Priority Data

Mar. 3, 1977 [DE] Fed. Rep. of Germany ..... 2709153

[51] Int. Cl.[2] ..... E29C 29/22

[52] U.S. Cl. ..... 299/43; 74/422; 105/29 R

[58] Field of Search ..... 299/42, 43; 105/29; 74/422

[56] References Cited

U.S. PATENT DOCUMENTS 1,435,341 11/1922 Sheal ..... 105/29 R 4,067,620 1/1978 Lantermann ..... 299/43

FOREIGN PATENT DOCUMENTS 2709111 9/1977 Fed. Rep. of Germany ..... 299/43

*Primary Examiner*—William Pate, III

*Attorney, Agent, or Firm*—Thomas H. Murray; Clifford A. Poff

[57] ABSTRACT

A rack device including a plurality of rack segments arranged end-to-end for extending along the side wall of a face conveyor while carrying a mining machine having a gear drive engageable with the rack device to propel the machine along the conveyor at the working face of a mine. The rack segments are joined at their abutting ends by pivot shafts to holders slideable along a rail that is supported by conveyor pan sections or side bracket portions of the face conveyor. The space between drive pins at the ends of the consecutively arranged rack segments is greater than the drive pin pitch by an amount corresponding to the distance of travel by these drive pins from an aligned relation of the rack segments into a maximum angular relation between the rack segments. Sliding movement by the holders on the rail is limited by one or more stop abutment members for each holder. A connecting link extends between two stop abutment members when employed at opposite sides of an individual holder. The holders include projections retained for sliding travel by a guide strip secured to the side bracket of the conveyor. The stop abutment members are also retained by the guide strip.

16 Claims, 7 Drawing Figures

RACK DEVICE FOR A DRUM CUTTER MINING MACHINE

BACKGROUND OF THE INVENTION

This invention relates to a rack device for a getting machine employed in underground mining, and more particularly to a drum cutter mining machine having a drive coupled to a segmented rack extending along a face conveyor and supported on conveyor pan sections or side bracket portions thereof.

It is known in the art to provide a getting machine which is driven along a rack made up of individual rack sections. In one known form of a rack, each rack section has a length corresponding to the length of a side bracket portion or to the length of a conveyor pan section forming part of a conveyor. The individual rack sections are pivotally joined together and rigidly mounted upon the side bracket portions of the conveyor. In this form of construction, the rack is able to follow the course of movement by the face conveyor because of the sectional subdivision of the rack and its relation to the face conveyor or the side brackets of the face conveyor. Moreover, the rack is adaptable to the conveyor position characteristics in both the vertical and horizontal directions. However, it is impossible to equalize the relative displacements between the segmented rack longitudinally of the conveyor because of positional adaptation by the face conveyor or side bracket on the one hand and the position of the rack on the other hand without altering the pitch to the rack teeth at the joints between abutting rack segments.

It has also been proposed to provide a gear rack made up of pivotally-joined rack segments. The gear rack is slideably guided in the longitudinal direction of the face conveyor. However, the rack is mounted onto the face conveyor at one location. The gear rack is also fixed in the longitudinal direction with respect to the face conveyor or side bracket thereof. The rack is flexible with respect to the face conveyor or side bracket along the entire region outside the mounting location and during the shifting operation by the face conveyor, the rack undergoes relative movement of varying magnitude with respect to the face conveyor.

SUMMARY OF THE INVENTION

It is an object of the present invention to provide a rack device employed to propel a getting machine along a mine face wherein the rack device is arranged on a face conveyor or on a side bracket thereof to provide the face conveyor or side bracket with the necessary freedom of movement for angular positioning in both the horizontal and vertical directions along the entire length of the conveyor.

According to the present invention, there is provided in combination with a mining machine, a rack device at the side wall of a face conveyor which includes a plurality of conveyor pan sections joined together end-to-end for extending along the path of travel by the mining machine at the working face of an underground mine, the face conveyor further including side bracket portions for extending along the stow side of the mining machine, the mining machine including gear drive means to drivingly engage the rack device which includes the combination of a plurality of elongated rack segments each having rack gear teeth at spaced intervals along the extended length thereof, the rack mounting means slideably carrying the rack segments for support by the conveyor pan sections or the side bracket portions, the rack mounting means including connector means joining the rack segments together in an end-to-end relation for guiding and limiting longitudinal sliding movement by the rack segments to maintain adequate spacing of the gear teeth at the gap between joined rack segments for driving engagement with the drive gear means.

To achieve the object of the present invention together with other features and advantages, the invention provides that the individual elongated rack segments of the rack device are supported and guided on the face conveyor or the side bracket of the face conveyor for longitudinal slideability therealong. Such longitudinal slideability for each of the rack segments insures that the face conveyor or the side bracket for the face conveyor is movable with the necessary freedom of movement relative to the mine face. This construction also assures that the interconnected rack segments have a necessary sliding movement to permit shifting of the face conveyor into positions adaptable to the characteristics of the mine floor. An important feature of the rack device according to the present invention is the elimination of jamming between the face conveyor and the side bracket thereof on the one hand and the rack segments on the other hand. In contrast to the construction of rack devices in the past, the required freedom of movement for shifting or angular setting without jamming of the rack segments is provided not only with respect to longitudinal rack portions situated at a substantial distance from the point of support but also this freedom of movement is provided for each longitudinal portion of the rack segment with respect to the conveyor pan section or side bracket portion associated therewith.

The longitudinal portions of the rack segments which bridge the joints between the conveyor pan sections or side bracket portions can be provided with holding means which are supported and guided on the face conveyor or on the side bracket with limited slideability while the holding means pivotally connect adjacent ends of the longitudinal rack segments.

According to this embodiment of the rack device of the present invention, the two adjacent ends of the rack segments are pivotally joined to each other by a common holding means or two rack segments are hinged together by a pivotal joint to a common holder. This requires that only the holders have longitudinal guiding means to obtain the necessary limited slideability.

The sliding travel of the individual rack portions or the sliding travel of holding means therefor corresponds at least to the relative motion between the rack and conveyor or the relative motion between the rack and the side bracket up to and including the greatest angular relation between adjacent conveyor pan sections or side bracket portions. The required movability of the face conveyor or of the side bracket relative to the rack is actually provided and assured under these conditions while jamming between rack segments is avoided.

In a rack device of the present invention, the two adjacent ends of rack segments are pivotally supported on a common holder by a bolt which extends transversely to the longitudinal orientation of the rack with the bolt being disposed beneath the driving pins used to form rack teeth. It is advantageous to provide that the mutual distance between the driving pins enclosing the pivotal joint between two rack segments is greater by a distance X than the normal pitch T between driving pins; where the distance X corresponds to the distance which two driving pins travel when approaching each other as the longitudinal portions of the rack segments are moved from an aligned relation to a maximum vertical angle relation. The holder used to interconnect the adjacent ends of two rack segments carries and spaces the segments such that the two driving pins which enclose the joint have a pitch increased beyond the normal pitch by an amount corresponding to T+X to thereby insure that the teeth of the driving wheel on the mining machine always penetrate through an adequately large tooth gap for engagement with the driving pins at the joint between rack segments even when the getting machine travels along dips in the mine floor.

In a further aspect of the present invention, the rack segments are carried by holders having an extended longitudinal length. The arrangement and length of the holders are such that the holders do not bridge a joint between the conveyor pan sections or a joint between the side bracket portions. These holders extend the length of the rack segments which do not bridge the joint between the conveyor pan sections or the side bracket portions. The arrangement and length of the holder are further characterized by the holders forming a longitudinal portion of the rack. The holders are preferably longitudinally slideable, supportingly and pivotally connected onto one of each of the conveyor pan sections or side bracket portions by means of adjacent rack segments which bridge the joint. All the longitudinal portions of the rack segments are shorter than the length of the conveyor pan sections or the side bracket portions. Thus, for example, where rack segments have a length of 750 millimeters corresponding to one-half the length of a conveyor pan section, a rack section is situated in the middle of each conveyor pan section and does not bridge the joint between the conveyor pan sections but is supported over its entire length by a holder or the holder itself forms a longitudinal portion of the rack segment. The two rack segments adjoining this centrally-located rack segment also have a length of 750 millimeters and bridge the joints between the conveyor pan sections. One end of these two adjacent rack segments is pivotally supported by the holder for the rack segment extending therebetween while the free ends of the adjacent rack segments are carried by successively-arranged holders on the conveyor pan sections located upstream and downstream therefrom.

It is also possible by the construction of parts according to the present invention to allow all holders for the rack segments to move with limited longitudinal slideability along a carrier strip or profiled rail on the side bracket portions or on the conveyor pan sections of the face conveyor. The carrier strip or profiled rail coextends with the length of the rack. This arrangement has independent merit in the art and it is particularly advantageous for converting an existing face conveyor designed to cooperate with a getting machine drawn by a chain and guided on a sectional rail. The sectional rail is utilized for the longitudinally slideable support and guidance of the rack. To this end, the rack is preferably arranged as far as possible above the carrier strip or above the sectional rail within a common vertical plane of symmetry with the carrier strip or the sectional rail so that the imposed forces due to the weight of the getting machine are transmitted without additional moments to the carrier strip or sectional rail.

The basic concept of the present invention can be utilized without employing a continuous guide rail. However, all the conveyor pan sections or all the side bracket portions of the conveyor will include at least one carrier strip portion or sectional rail portion which has a length corresponding to the length of sliding travel by the associated rack segment. A reduction to the construction expenditure which is otherwise required for a continuous sectional rail is gained by employing only carrier strip portions or sectional rail portions of this kind.

Preferably, sliding travel by the rack segments is limited to stop abutment members which can be either rigidly or non-rigidly connected to each conveyor pan section or side bracket portion or to the carrier strip or to the sectional rail. In this arrangement of parts, every two stop abutment members which enclose a holder between them, are connected to each other by means of a link and their distance from each other can be adjusted. In this way, sliding movement between the face conveyor or the side bracket in relation to the rack is adjustable within specific limits. Guiding and support of the holders are improved when the holders grip around the link which interconnects two stop abutment members.

It is preferred to provide a guide strip located outside the vertical plane of symmetry of the carrier strip or sectional rail. This guide strip extends along the distance of sliding travel by the holders and functions to provide an abutment surface for an extension to the holders and to provide an abutment surface for the stop abutment members to thereby absorb all movements which act on the holders and tend to twist them about the axis of the sectional rail by transmitting such moments into, for example, the side bracket of the conveyor.

When necessary or desirable, the rack segments are constructed so that their individual lengths differ some with respect to others through a lengthening or shortening by at least one drive pin pitch. The lengthened or shortened rack segments are used to maintain correct positioning of a holder with respect to the conveyor pan section or the side bracket portion such that the rack segments or their holders always assume a predefined position with respect to the conveyor pan section or side bracket portion supporting the same when the racks are installed underground and longitudinal differences between the conveyor pan and the rack occur, e.g., when individual conveyor portions are set closer or farther apart from each other. The differences, because of such positioning between individual conveyor portions, are thus equalized.

It is also preferred to provide stop abutment members with a clamping jaw which is supported by a hinged arrangement to grip around the sectional rail. The clamping jaw is arranged for pivotal movement about an axis which is parallel to the axis of the sectional rail and retained by clamping screws. The support surface of the clamping jaw preferably includes knurling to improve frictional engagement between the carrier strip or sectional rail and the stop abutment member.

These features and advantages of the present invention as well as others will be more fully understood when the following description is read in light of the accompanying drawings, in which.

Figure 1:
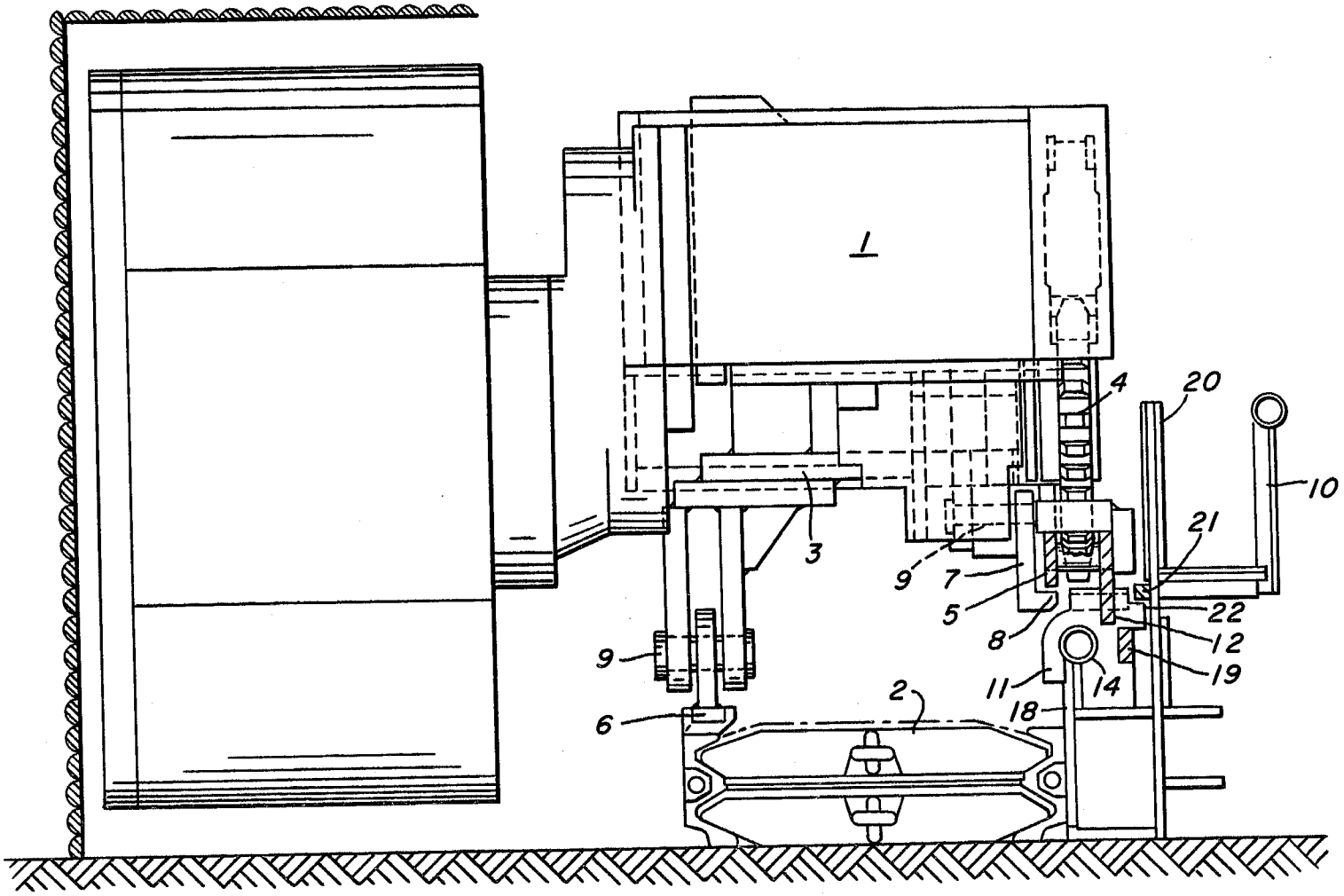
FIG. 1 is an end elevational view of a drum cutter mining machine traversable on a face conveyor by driving engagement with a rack device according to the present invention.
Figure 3:
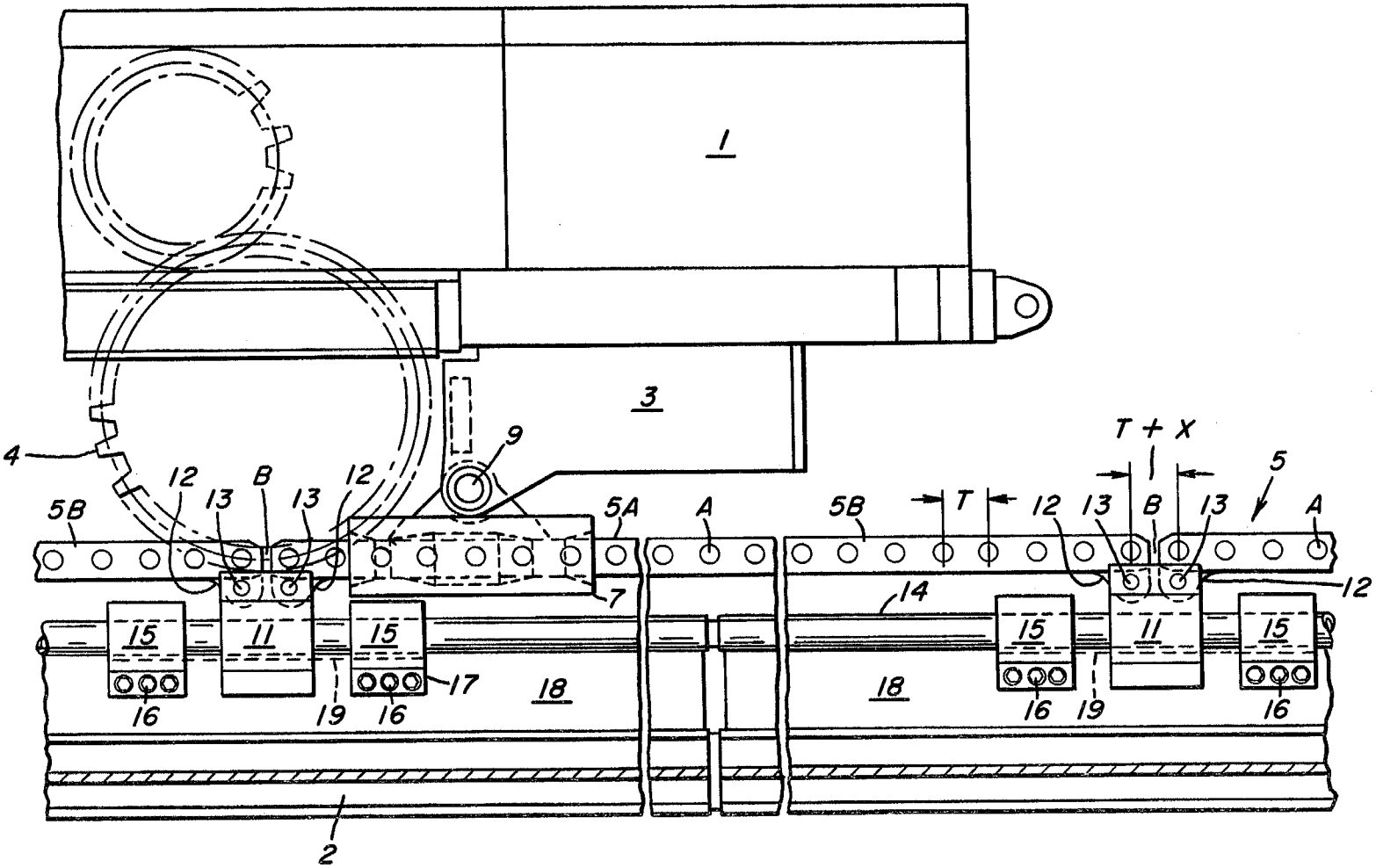
FIG. 3 is a partial side view taken along line III—III of FIG. 1.

In FIGS. 1 and 3, reference numeral 1 denotes a drum cutter mining machine. The drum cutter mining machine includes a machine frame 3 traversed along a face conveyor 2 by means of a driving gearwheel 4 meshing with a pinion gear of a drive on the mining machine. Driving gearwheels mesh with a rack 5 extending along the path of travel by the mining machine. The side of the mining machine at the working face of an underground mine is supported by means of skids 6 on the face conveyor 2. The stow side of the mining machine is supported by means of skids 7 on the rack 5. The skids 7 include an extension 8 extending beneath the rack to insure proper tooth engagement with the driving wheel 4. The skids 6 at the working face side of the mining machine and skids 7 at the stow side thereof are pivotally connected to the machine frame 3 by bolts 9 extending transversely to the direction of travel by the mining machine along the face conveyor.

Figure 4:
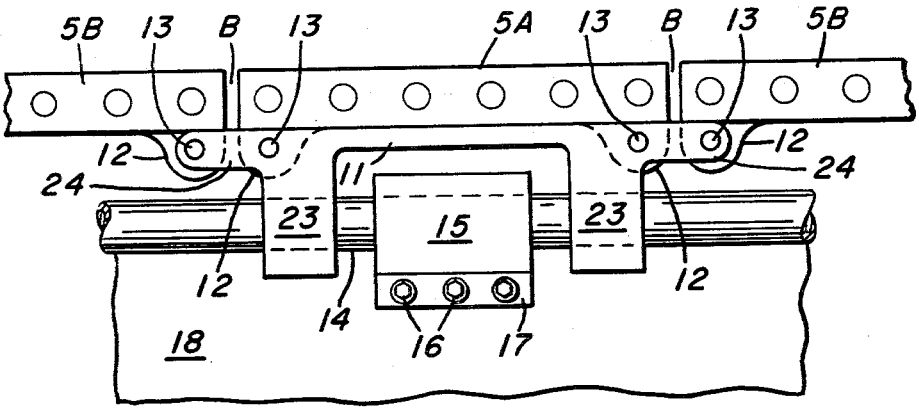
FIG. 4 illustrates a modified form of the rack device shown in FIG. 3.
Figure 5:
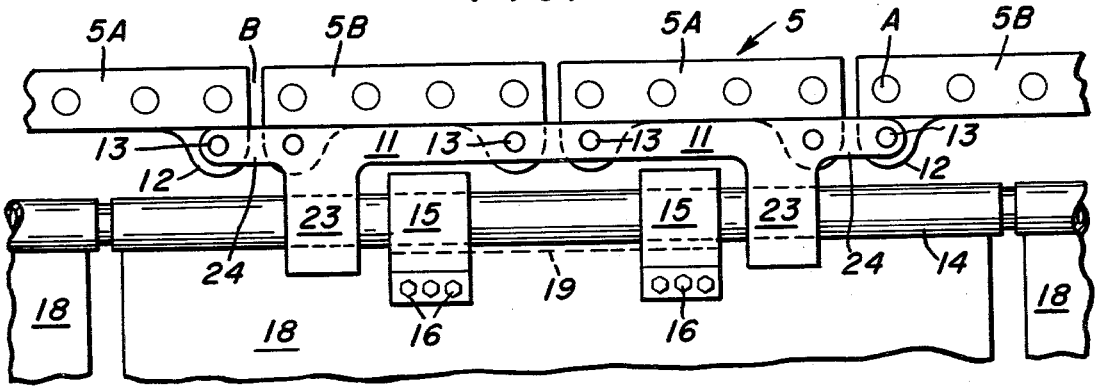
FIG. 5 is a view similar to FIG. 4 but illustrating a further modification to a holder in a rack device of the present invention.

In the form of the invention shown in FIG. 3, the rack 5 is made up of a plurality of individual elongated rack segments 5A and 5B. The length of each rack segment 5A and 5B corresponds to the length of conveyor pan sections or the length of side bracket portions which are well known in the art and usually defined as part of a face conveyor. The rack segments 5A and 5B are positioned to coextend with the length of the conveyor pan portions or side bracket portions or, alternatively, the rack segments are arranged in an offset manner so as to bridge a joint between the conveyor pan sections or the side bracket portions. As illustrated in FIGS. 4 and 5, the rack segments 5A and 5B can, however, be shorter than the length of the conveyor pan section or side bracket portion and the rack segments can bridge the joints between these components of the face conveyor. In all cases, the rack 5 is supported and guided for limited slideability relative to the side bracket generally indicated in FIGS. 1 and 2 by reference numeral 10. The rack 5 is, therefore, supported and guided for limited slideability relative to the face conveyor 2 in the longitudinal direction of the working face of the mine. The slideable arrangement of the rack is made possible without impairing the pitch between the driving pins at the joints between rack segments only if the rack segments 5A and 5B are pivotally connected to each other either directly or by, for example, means of a hinge or indirectly by means of a holder 11. Different forms of holders 11 are shown in FIGS. 3-5. Each form of holder receives eyelet extensions 12 provided at the opposite ends of rack segments 5A and 5B. The eyelet extensions are pivotally connected to the holders by means of bolts 13 which extend transversely to the longitudinal arrangement of the rack segments.

As shown in FIG. 3, the adjacent ends of two rack segments 5A and 5B are interconnected by a holder 11 which is longitudinally slideable and guided on a sectional rail 14. The segments of the sectional rail are each arranged end-to-end to extend along the entire length of travel by the drum cutter mining machine and this length of travel corresponds to the extended length of the conveyor pan sections and the side bracket portions of the conveyor. Each rack segment includes rack teeth formed by driving pins A which are carried at spaced-apart and regular intervals along the segment. The regularly-spaced intervals of the drive pins define the pitch T of the rack teeth. The holder 11 maintains the ends of two adjacent rack segments 5A and 5B at a distance B from each other. The distance between two driving pins at the ends of the rack segments which enclose the joint between them is increased by an amount X from the pitch T between the driving pins. The distance X is selected so that the sum of the distances corresponding to T+X between the two driving pins A which enclose the joint between adjacent rack segments cannot be reduced to such an extent that this distance is less than the driving pin pitch T. However, the distance between the driving pins at the adjacent ends of the rack segments varies as the rack segments assume angular positions from an aligned relation along their extended lengths. Thus, at a maximum vertical angle between extended rack segments, the dimension T+X is not reduced below the driving pin pitch T. There is always a gap between the driving pins A for the required engagement with the teeth of the driving wheel 4 even when, for example, there is a dip in the mine floor that produces a downwardly-sloping relation toward the joint between the rack segments 5A and 5B.

In the embodiment of the present invention shown in FIG. 3, two stop abutment members 15 enclose one holder 11 between them and thereby define limits to the sliding travel by the holder. The stop abutment members 15, like the holders 11, embody an integral casing which includes a bore or opening corresponding to the configuration of the rail 14 in cross section. During assembly of the face conveyor 2 and the rack 5, the holders 11 and abutments 15 are fitted onto appropriate rail sections 14 by means of the bore or opening therein. The holders 11 are disposed on rail sections 14 for sliding movement along the rail sections but this sliding movement is restricted by two stop abutment members 15. The abutment members are carried on the rail and positioned at opposite sides of the holder where the abutment members are connected in a non-positive manner to a rail section 14. To provide such a connection, screw fasteners 16 are passed through threaded holes in a flange 17 formed as part of each stop abutment member and extending downwardly beneath rail section 14. The fasteners 16 bear on one of the divided carrier plates 18 used to support the sectional rail 14. The fasteners 16 are torqued to impose sufficient stress on the stop abutment members to fix their location on the sectional rail 14.

Figure 2:
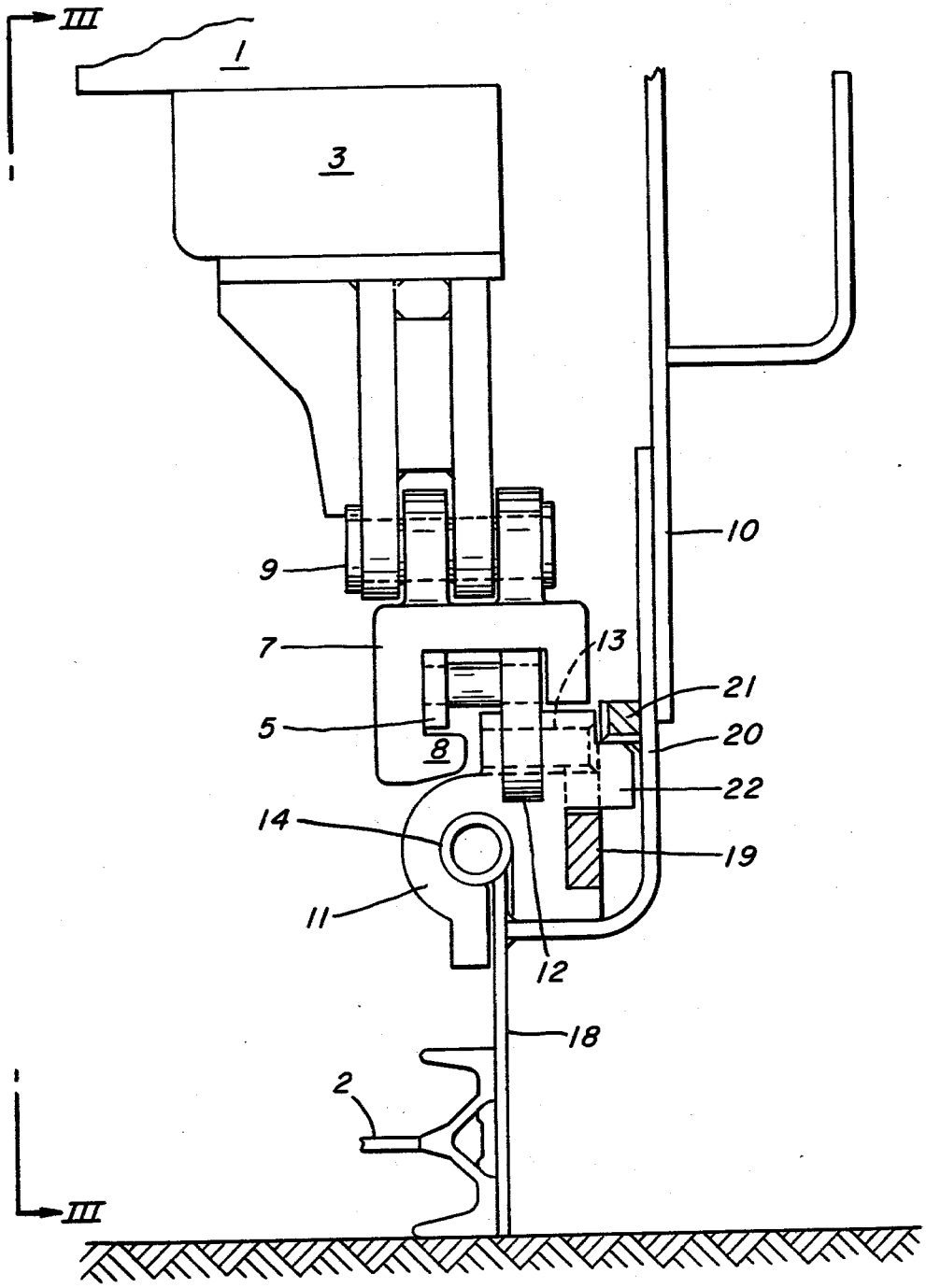
FIG. 2 is a view similar in FIG. 1 but illustrating an enlarged view of a modified rack device according to the present invention.

Every two stop abutment members 15 which enclose a holder between them are interconnected by a link 19 arranged to extend parallel with the guide rail section 14. A screw fastener 29 extends through a bore within an aligned row of bores 30 provided in the link 19 for attaching the link to each of the two stop abutment members 15. By this construction, the stop abutment members 15 can be set at a different distance from each other and the required sliding travel of the rack is thus defined to meet any specific requirement. As shown in FIG. 2, the holder 11 engages link 19 to improve guided sliding travel by the holder. Wall 20 of the side bracket 10 is used for mounting a guiding strip 21 thereon. The guiding strip is situated outside the perpendicular plane of symmetry of the sectional rail 14. Extension 22 from each holder 11 as well as extensions from the stop abutment members 15 pass beneath the guide strip to engage the bottom surface of the strip. The torque produced by the weight of the mining machine produces a resultant force on the holders 11 and the stop abutment members 15. The force produced by this torque is absorbed through the guide rail by the bracket wall 20. The guide strip 21 extends over the entire length of the bracket wall 20. Alternatively, if desired, the guide strip may take the form of short guide strip portions each having a length adapted to maintain engagement with the holder 11 throughout its sliding travel.

In the embodiment of the invention shown in FIG. 4, the holder 11 is constructed to extend over the entire length of a rack segment 5A and connected thereto by means of bolts 13. The rack segments 5A and 5B of the rack 5 define a length corresponding to one-half the length of a conveyor pan section or a side bracket portion of the conveyor. By this length of parts and relationship only every second rack segment bridges a joint between the conveyor pan sections or the side bracket portions of the conveyor. The holder 11 which extends along the entire length of rack segment 5A must always be arranged so that extensions 23 of the holder engage a common portion of a rail section 14 to avoid restrictions to the degree of angular positioning between the conveyor pan sections or the side bracket portions of the conveyor. A holder 11 constructed in this manner requires only one stop abutment 15 which is mounted onto the rail section 14 at a location between extensions 23 of the holder. The holder 11 includes projections 24 connected at each end to rack segments 5B which bridge the joint between the conveyor pan sections or the side bracket portions. Projections 24 extend beyond the ends of the rack segment 5A. The eyelet extensions 12 of the adjacent rack segments 5A and 5B are pivotally connected to the holder 11 by bolts 13.

As shown in FIG. 5, two rack segments 5A and 5B are mounted onto a holder 11 which is constructed in the same manner as described above. In FIG. 5, the rack sections have a length of 500 millimeters so that every two rack sections are disposed on one holder 11 and secured thereto by means of bolts 13. Each of the rack segments 5A and 5B that are joined to the rack segments carried by the holder 11 is separated by space B and bridge the joints in the sectional rail 14 and the joints between the conveyor pan sections or side bracket portions. The rack segments which bridge the joints between these members are joined to the holders 11 by means of eyelet extensions 12 and holder projections 24. At the joints between sectional rail 14 or conveyor pan sections, the holders provide the rack 5 with movability in the vertical and horizontal directions which is required for shifting the face conveyor 2. This reduces the amount of angular setting of the conveyor pan sections caused by an undulating floor within the extent of the rack.

Figure 6:
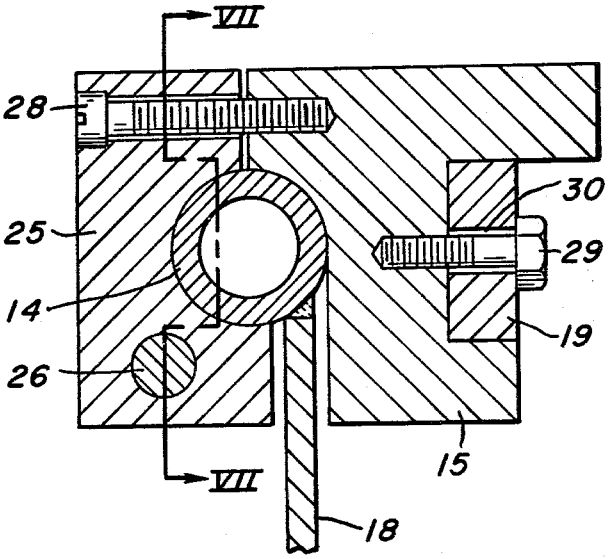
FIG. 6 is a sectional view taken along line VI—VI of FIG. 7 and illustrating a clamping arrangement for a stop member in the rack device of the present invention.
Figure 7:
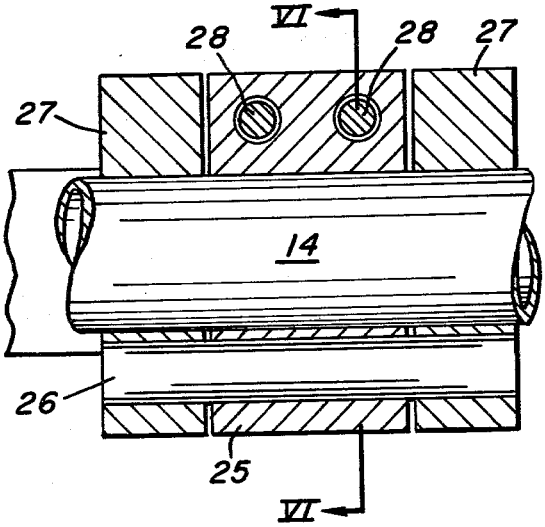
FIG. 7 is a sectional view taken along line VII—VII of FIG. 6.

FIGS. 6 and 7 illustrate a preferred embodiment of the stop abutment member 15. Each stop abutment member includes a clamping jaw 25 arranged in a manner to form part of a hinge. The clamping jaw 25 is retained by a bolt 26 which extends in a direction parallel with the sectional rail 14 which also corresponds to the direction of travel by the mining machine along the mine face. The bolt 26 projects from the opposite sides of the clamping jaw into nose sections 27 also forming part of the stop abutment member 15. The clamping jaw 25 is pivoted about bolt 26 and the free end of the jaw is retained by means of screws 28 engaged in bores formed in the stop abutment member 15. The screws 28 are used to stress the hinge portion 25 against the sectional rail 14 with sufficient force to insure that the stop abutment member and the sectional rail are connected together but in a non-positive manner, e.g., by frictional contact. The surfaces of the abutment member may be knurled to increase gripping contact with the sectional rail 14.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. In combination with a mining machine, a rack device at the side wall of a face converyor which includes a plurality of conveyor pan sections joined together end-to-end for extending along the path of travel by the mining machine at the working face of an underground mine, said face conveyor further including side bracket portions for extending along the stow side of the mining machine, said mining machine including gear drive means to drivingly engage the rack device which includes the combination of:

a plurality of elongated rack segments each having rack gear teeth at spaced intervals along the extended length thereof, at least some of said rack segments bridging the joints between conveyor pan sections or side bracket portions, and rack mounting means slideably carrying said rock segments for support by said conveyor pan sections or said side bracket portions, said rack mounting means including holders to support said rack segments, connector means including means to pivotally interconnect adjacent ends of adjoined rack segments with a holder in an end-to-end relation for guiding and limiting longitudinal sliding movement by the rack segments to maintain adequate spacing of gear teeth at the gap between joined rack segments for driving engagement with said drive gear means.

2. The rack device according to claim 1 wherein the sliding travel by longitudinal portions of adjoined rack segments corresponds to at least the relative motion between the rack segments and said conveyor pan sections or said side bracket portions when the latter are set at a maximum relative angle.

3. The rack device according to claim 1 wherein said rack mounting means includes a holder coupled by pivots to support each end of two adjacent rack segments, said pivots extending transversely below the rack gear teeth which include drive pins, the mutual distance between the drive pins at the ends of adjacent rack segments being greater by a distance X than the pitch spacing intervals of drive pins in a given rack segment, where said distance X is defined as the linear distance of travel by the drive pins at the ends of adjacent rack segments between an aligned relation of the rack segments and a maximum angular relation to the rack segments.

4. The rack device according to claim 1 wherein the rack gear teeth of said rack segments include drive pins and wherein the number of drive pins in each of a given two adjoined rack segment differs by one drive pin to maintain correct positioning of said holders with respect to said conveyor pan sections or said side bracket portions.

5. The rack device according to claim 1 wherein said holders having extended lengths to pivotally connect rack segments positioned to bridge the joint between conveyor pan sections or side bracket portions while the holders are connected with rack segments extending along conveyor pan sections or side bracket portions.

6. The rack device according to claim 1 further including carrier strips engaging said conveyor pan sections or side bracket portions for extending along the lengths of adjoined rack segments to support said holders.

7. The rack device according to claim 1 further including a sectional rail carried by said conveyor pan sections or side bracket portions for extending along the length of adjoined rack segments to support said holders.

8. The rack device according to claim 6 or 7 wherein said rack segments extend above said carrier strips or sectional rail within a common plane of symmetry therewith.

9. The rack device according to claim 6 wherein each conveyor pan section or side bracket portion supports at least one of said carrier strips having a length corresponding to at least the distance of sliding travel by the rack segments supported thereby.

10. The rack device according to claim 7 wherein each conveyor pan section or side bracket portion supports a segment of said sectional rail having a length corresponding to at least the distance of sliding travel by the rack segments supported thereby.

11. The rack device according to claim 1 further including stop abutment members at spaced-apart intervals along the face conveyor for limiting longitudinal sliding travel by said rack segments.

12. The rack device according to claim 11 wherein said rack mounting means includes holders and wherein said rack device further includes a link interconnecting two of said stop abutment members at opposite sides of an individual one of said holders.

13. The rack device according to claim 12 wherein said link is surrounded by a portion of the individual one of said holders.

14. The rack device according to claim 6 or 7 further including a guide strip extending along the path of sliding travel by said holders at an outwardly-spaced location from a vertical plane containing said carrier strips or said sectional rail, and stop abutment members at spaced-apart intervals along the face conveyor retained by said guide strip for limiting longitudinal sliding travel by said rack segments, said holders including extension members retained by said guide strips for sliding movement of said holders.

15. The rack device according to claim 11 wherein said stop abutment members each includes a hinged clamping jaw carrier by a pivot shaft for pivotal movement about an axis extending generally parallel to the path of travel by the mining machine, and a screw member for stressing emplacement of the abutment member.

16. The rack device according to claim 15 wherein said clamping jaw includes a knurled support surface.

* * * * *